US006712841B2

(12) United States Patent
Gomez

(10) Patent No.: US 6,712,841 B2
(45) Date of Patent: Mar. 30, 2004

(54) METHODS AND APPARATUS FOR TREATING HEMORRHOIDS AND SIMILAR AILMENTS

(75) Inventor: Rebecca Gomez, New York, NY (US)

(73) Assignee: Florez & Co., New York, NY (US)

( * ) Notice: Subject to any disclaimer, the term of this patent is extended or adjusted under 35 U.S.C. 154(b) by 0 days.

(21) Appl. No.: 09/781,342

(22) Filed: Feb. 12, 2001

(65) Prior Publication Data

US 2003/0144715 A1 Jul. 31, 2003

(51) Int. Cl.[7] ..... A61F 7/00; A41B 9/00

(52) U.S. Cl. ..... 607/114; 2/400; 2/78.3; 450/115

(58) Field of Search ..... 607/114, 108, 607/112, 96; 2/466, 73, 78.1, 78.2–78.3, 78.4, 109, 400–408; 450/94, 99–108, 115, 116

(56) References Cited

U.S. PATENT DOCUMENTS

| | | | | | |
|---|---|---|---|---|---|
| 3,871,376 | A | * | 3/1975 | Kozak | 604/291 |
| 4,240,436 | A | * | 12/1980 | Singleton | 606/191 |
| 4,325,379 | A | | 4/1982 | Ozbey | |
| 4,400,832 | A | | 8/1983 | Kinder | |
| 4,563,182 | A | | 1/1986 | Stoy et al. | |
| 4,626,433 | A | | 12/1986 | Gros | |
| 4,761,843 | A | | 8/1988 | Jay | |
| 4,844,073 | A | | 7/1989 | Pohler | |
| 5,167,655 | A | * | 12/1992 | McCoy | 2/406 |
| 5,325,543 | A | * | 7/1994 | Allen | 2/400 |
| 5,392,467 | A | * | 2/1995 | Moretz et al. | 2/114 |
| 5,398,346 | A | | 3/1995 | Feinberg et al. | |
| 5,611,722 | A | | 3/1997 | Osborne | |
| 5,784,723 | A | * | 7/1998 | Noble et al. | 2/228 |
| 6,068,607 | A | * | 5/2000 | Palmer et al. | 602/67 |
| RE36,905 | E | * | 10/2000 | Noble et al. | 2/228 |

FOREIGN PATENT DOCUMENTS

| | | |
|---|---|---|
| FR | 2468319 | 5/1981 |
| JP | 09220253 | 8/1997 |
| JP | 09316701 | 12/1997 |

* cited by examiner

*Primary Examiner*—Michael Peffley
(74) *Attorney, Agent, or Firm*—Fish & Neave; Robert W. Morris; George L. Kanabe

(57) ABSTRACT

Methods and apparatus for treating hemorrhoids and similar ailments are disclosed in which one or more piece of material are used to separate swollen, inflamed tissue from non-swollen tissue, material may be included within an undergarment that may be worn for the treatment of ailments such as hemorrhoids or an episiotomy. The material incorporated into the undergarment has elastic properties that, in the case of hemorrhoids, acts to separate the buttocks. The undergarment may also include one or more pocket enclosures to hold cold compresses, ice packs, pain ointment, etc. directly upon, or in close proximity to, the affected area. Alternately, the material may be one or more single-use strips that include adhesive such that the strips act to separate the affected area from the non-affected area.

22 Claims, 3 Drawing Sheets

METHODS AND APPARATUS FOR TREATING HEMORRHOIDS AND SIMILAR AILMENTS

BACKGROUND OF THE INVENTION

This invention relates to the treatment of ailments in which there is swelling of a particular area of a person's body, such as with hemorrhoids or as a result of an episiotomy. More particularly, this invention relates to belts and belt attachments that act to alleviate the discomfort and pain caused from swollen body tissue.

There are numerous ailments that cause significant discomfort and pain as a result of swollen body tissue. Hemorrhoids, for example, are swollen blood vessels in and around the anus and lower rectum that have been stretched from the pressure of normal bodily functions. These swollen blood vessels, which can bleed, itch and/or cause great pain and discomfort, are classified as either internal or external. Internal hemorrhoids lie within the rectum, but can sometimes grow large enough so that they protrude outside the anal sphincter. External hemorrhoids lie within the anus area and, likewise, are often quite painful. Once swollen, additional discomfort can be caused by such simple tasks as walking, when friction causes rubbing of the swollen area.

Similar discomfort and pain often occur as a result of an episiotomy—a procedure often used by physicians to attempt to prevent tearing of the vaginal area during childbirth. The incision made during an episiotomy often results in very swollen tissue in and around the area of the episiotomy. In addition to the pain and discomfort caused by the incision itself, pain and discomfort may also result from friction when other parts of the body, such as the thighs, rub against the swollen area.

Both of these, as well as similar ailments, are widespread. Hemorrhoids, for example, is a very common problem that afflicts many men, women and children worldwide. It is estimated that almost half of all people have hemorrhoids by age 50. Hemorrhoids are particularly common among pregnant women because the pressure caused by the fetus during pregnancy, the hormonal changes, and the severe pressures during childbirth often cause the hemorrhoidal vessels to swell.

There are no proven single or direct causes of hemorrhoids. Studies focus on possible causes such as constipation, diarrhea, genetic predispositions to sitting for too long a time period, but all without conclusive findings. The most consistent demonstrated abnormality is an increased maximum resting anal pressure. Hemorrhoids, like the area affected by an episiotomy, have extremely sensitive tissue that require non-motion and rest in order to advance the healing process. Both ailments, as well as other similar ailments, are sometimes treated by the application of ice packs, for example, to attempt to reduce swelling.

In particular, both internal and external hemorrhoids have been treated by a variety of methods including surgery, medication, ice packs, diet, increased water intake, chemical injections, lasers or a combination of techniques. A number of surgical methods also can be used to remove or shrink the size of internal hemorrhoids. These methods may include: rubber band ligation and sclerotherapy. Rubber band ligation, for example, involves placing a rubber band around the base of the hemorrhoid in order to cut off circulation. Sclerotherapy, on the other hand, involves injecting a chemical solution around the blood vessel in order to shrink the hemorrhoid. Alternatively, laser coagulation or infrared light can be used to burn away the hemorrhoid. In addition, a hemorrhoidectomy may be performed on severe hemorrhoids in which the hemorrhoid is permanently surgically removed.

While these surgical techniques are aimed at total elimination of hemorrhoids, often, less drastic medical treatment may be employed to reduce the symptoms of hemorrhoids. Such measures can include: taking a warm bath several times a day, using ice packs to reduce swelling, taking stool softeners, and/or applying hemorrhoidal cream or a suppository to the affected area. A high fiber and increased non-alcoholic beverages are also recommended in order to prevent pressure on the hemorrhoids caused by straining when emptying the bowels and preventing constipation. However, once a patient has developed a hemorrhoidal condition, it is often difficult for a person to find quick relief.

Similar measures are often suggested to ease the discomfort of women who were subjected to an episiotomy during childbirth. For example, often, during the first days following the delivery, ice packs or cold compresses are applied to the affected area. One problem is that it is often difficult to keep the ice pack properly aligned with the affected body tissue.

While trying to ease the discomfort of these ailments, it is important to ease the pressure on the swollen tissue. Gravity forces continuous pressure on these fragile blood vessels, e.g., when a person sits or stands, the abdominal pressure and leg and buttocks friction can aggravate both the hemorrhoidal and episiotomy situations. In the past, patients have often tried to alleviate this pressure by sitting on a donut-shaped cushion or pillow. However, this cushion is only useful when a person sits and does not address the discomfort when a person stands or sleeps.

In view of the foregoing, it would be desirable to provide methods and apparatus that provide relief for the discomfort caused by swollen body tissue at any time of the day or night.

It is also desirable to provide methods and apparatus that provide relief for the discomfort caused by swollen body tissue during sleep.

It is also desirable to provide methods and apparatus that relieve unnecessary pressure due to swollen tissue discomfort by separating other body parts from the swollen area.

It is also desirable to provide methods and apparatus for alleviating the discomfort caused by swollen tissue that are reusable and cleanable.

It is also desirable to provide methods and apparatus for maintaining treatment applications in proper alignment with the affected area of the body.

It is also desirable to provide methods and apparatus for alleviating the discomfort caused by swollen tissue that are inexpensive and may discarded after each use.

SUMMARY OF THE INVENTION

It is, therefore, an object of the present invention to provide a methods and apparatus that provide relief for the discomfort caused by swollen body tissue at any time of the day or night.

It is also an object of the present invention to provide methods and apparatus that provide relief for the discomfort caused by swollen body tissue during sleep.

It is also an object of the present invention to provide methods and apparatus that relieve unnecessary pressure due to swollen tissue discomfort by separating other body parts from the swollen area.

It is also an object of the present invention to provide methods and apparatus for alleviating the discomfort caused by swollen tissue that are reusable and cleanable.

It is also an object of the present invention to provide methods and apparatus for maintaining treatment applications in proper alignment with the affected area of the body.

It is also an object of the present invention to provide methods and apparatus for alleviating the discomfort caused by swollen tissue that are inexpensive and may discarded after each use.

These and other objects of the present invention are accomplished in accordance with the principles of the invention by providing methods and apparatus for alleviating pressure and friction due to rubbing from swollen areas of the body. In particular, the present invention provides a wearable device that, when worn, separates the swollen body area from other parts of the body. This reduces the amount of irritating friction that would otherwise occur, and it also tends to expose the inflamed area to the air to aide in the healing process by permitting drying to occur. The wearable device may be in the form of underwear (such as panties for women), or it may be in the form of single-use, partially adhesive, strips that perform the separate function. An additional feature of the underwear form of the present invention is the optional inclusion of a pocket for holding a cold compress or other treatment device in proper alignment with the affected area.

The present invention may be useful in aiding the treatment of any number of ailments relating to swollen tissue. For example, women who have undergone an episiotomy during childbirth, could wear a panty configured, in accordance with the principles of the present invention, to include a pocket that holds a cold compress or ice pack against the swollen genital area. In addition, the pocket may include, for example, the capacity to absorb or retain any condensation formed as the cold object warms, thereby preventing the wearer's clothing from getting wet. Alternatively, the same woman might wear a differently configured panty if, for example, she also suffered from hemorrhoids as a result of childbirth. In that instance, the panty may also include one or more panels to separate the buttocks to ease the healing process of the hemorrhoids.

The present invention may also include a wearable device that is specifically configured to provide relief for hemorrhoid discomfort during sleep. This device, as well as other embodiments of the present invention, provides relief from discomfort and irritation by reducing friction between the affected area and other body parts. For the treatment of hemorrhoids in particular, the present invention also provides relief by separating the buttocks, thereby removing unnecessary pressure on the hemorrhoids. There is also provided relief from discomfort resulting from an episiotomy.

The wearable devices of the present invention may be reusable and launderable, such as panties that can be thrown in the laundry, or they may include single-use devices such as wearable strips that include portions of adhesive to perform the separation function. The single-use strips would preferably be hypo-allergenic and/or waterproof. In addition, any of the wearable devices of the present invention may contain one or more pockets that can hold, for example, a cold compress, an ice pack, a heating pad, a hot compress or medicated ointment.

One advantage of the present invention is the immediate relief from pain and/or discomfort to the suffering patient because it immediately takes pressure off of the affected area. For example, with regard to hemorrhoids, the present invention takes pressure off of the buttocks cheeks, which in turn, removes pressure from the affected hemorrhoids. Another advantage of the present invention is that users will be able to apply and/or remove cold compresses or healing ointments as needed, and that they will be retained in proper alignment with the affected area without the need for constant readjustment, thereby, allowing for more user control of the healing process with less inconvenience.

An advantage of the single-use strips embodiment of the present invention is that they can be used to provide immediate pain relief in a convenient form. For example, one or more strips may be easily carried in a purse or bag, while it may be impractical to carry around a treatment panty. In addition, the single-use strips may be more readily available for purchase at drug stores, or similar stores. Moreover, the single-use strips may be used during anal surgery to separate a patient's buttocks cheeks such that human intervention is not required to maintain the necessary separation. Another advantage of the single-use strips versus a panty-like device is that a person suffering from swollen tissue discomfort can take warm baths while wearing the single-use strips so that the warm water may directly help ease inflammation and pain.

BRIEF DESCRIPTION OF THE INVENTION

The above and other objects and advantages of the invention will be more apparent upon consideration of the following detailed description of the preferred embodiments, taken in conjunction with the accompanying drawing(s), in which like reference characters refer to like elements throughout, and in which.

It is to be understood that the drawings are designed for purposes of illustration only, and are not intended as a definition of the limits and scope of the invention disclosed.

DETAILED DESCRIPTION OF THE INVENTION

The present invention is directed to methods and apparatus for the treatment of swollen body tissue. In particular, the present invention includes method and apparatus for easing the discomfort caused by irritation and swelling from ailments related to swollen body tissue, such as hemorrhoids and episiotomies. Discomfort is eased and healing may be accelerated by separating non-swollen tissue from the affected area, thereby relieving pressure from the affected area and permitting the affected area to dry.

Figure 1:
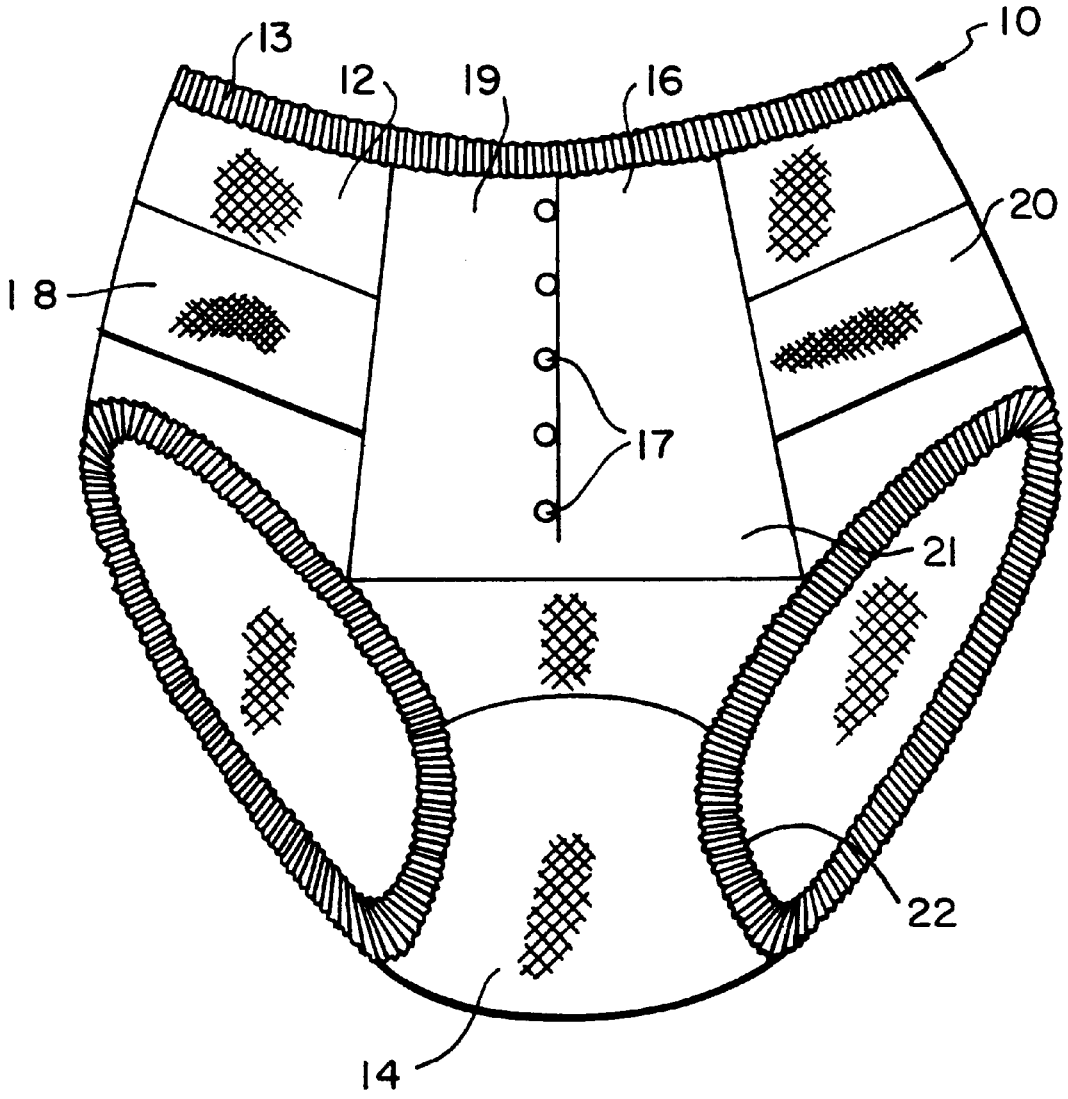
FIG. 1 is an illustrative front view of a wearable device that separates swollen tissue from non-swollen tissue in accordance with the principles of the present invention.

FIG. 1 shows an illustrative front view of a panty undergarment 10, constructed in accordance with the principles of the present invention. Panty undergarment 10 may be constructed of various different materials, each having different properties (such as the amount of flexibility therein), or from a single material, provided that the single material may be manufactured to produce varying properties. For example, there are known materials which can be manufactured to form supporting pockets in one portion and relatively stiff elastic portions elsewhere (such as in the area of brassieres, where a single piece of material forms the cup for the breast, but also forms the resilient side portions, without any break in the fabric). As described herein, the present invention utilizes the different properties to provide a user with a comfortable fit while still acting to separate swollen tissue from non-swollen tissue.

The front of panty undergarment 10, for example, may comprise a body portion 12, a crotch portion 14, a front panel 16, belt portions 18 and 20 (which are located on either side of body portion 12), and an optional pocket portion 22. Body portion 12 may be made from any substantially flexible, stretchable, breathable, fabric, such as cotton, neoprene or some combination thereof, or other such material, to provide comfort to the user. It may include an elastic, or semi-elastic belt portion 13 to help keep the undergarment on. Front panel 16 may be made from the same material as body portion 12, or from a different material, or front panel 16 may be integrated into body portion 12, so that body portion 12 completely surrounds the waist of the user.

As shown in FIG. 1, front portion 16 may include one or more attachment mechanisms 17, that may be used to make it easier for a user to put on and take off garment 10. For example, attachment mechanisms 17 may be buttons, snaps, a zipper, VELCRO, the fastening hook and loop material, or any other conventional means for attachment. This provides for front panel 16 to open in two flaps 19 and 21. It should be noted that belt portion 13 would also separate in such configurations. Such a configuration may be easier for a user to put on and take off due to elastic belt portions 18 and 20 (which act to separate the swollen tissue from non-swollen tissue).

Crotch portion 14 may also be made from the same material as body portion 12, but, particularly for female configurations, may include an absorbent inner lining of cotton or similar propertied material. Crotch portion 14 may be designed so that panty undergarment 10 comfortably fits either a male or female person, or it may be designed specifically for each sex. Crotch portion 14 may also contain one or more pocket portions 22, which each would be capable of holding a swollen tissue treatment device, such as a cold compress or ice pack, in proper alignment against an affected area. Pocket portion 22 allows substantially direct contact between the contents of pocket portion 22 and the affected area so that immediate and extended relief can be obtained by the user, without the need to constantly adjust the treatment item.

While pocket portion 22 may appear to cover the entire crotch area, persons skilled in the art will appreciate that one or more individual pockets may be included. For example, a single undergarment 10 may include two pocket portions 22—one for treatment of an episiotomy and the other for treatment of hemorrhoids. Alternately, a single pocket portion 22 may be included that would be aligned with the buttock area for the treatment of hemorrhoids. In any case, it also may be preferred for pocket portion 22 to include both an absorbent material, as well as a material that repels moisture. These materials would, for example, retain condensation that may form while a cold compress warms up, so that the user's clothes do not become wet.

Belt portions 18 and 20 are substantially parallel belts that perform the separation of affected tissue from non-swollen tissue in accordance with the present invention. Belt portions 18 and 20 are panels formed from an elastic or semi-elastic material, which may be adjustable in order to fit different shaped users within a given size. Belt portions 18 and 20 may also include frictional members (not shown), such as small rubber knobs that further enhance the separation action of the belts. Additionally, belt portions 18 and 20 may be adjustable to vary the tension with which the body portions are pulled. The adjustability of belt portions 18 and 20 may be varied by adjusting, for example, a belt buckle, a latch, a slide (which is secured on one end and slides up or down the belt to loosen or tighten the belt), or other suitable adjusting material, such as VELCRO, the fastening hook and loop material.

Belt portions 18 and 20 may also be made from a highly flexible fabric that automatically adjusts itself for each person and does not require further adjustments. As belt portions 18 and 20 are adjusted more tightly, the buttocks cheeks further separate thereby allowing for instant relief from hemorrhoid discomfort. Similarly, belt portions 18 and 20 may be located in a different and/or lower position, and garment 10 may include leg portions (not shown), in an effort to pull non-swollen tissue and clothing away from the genital area for women who have recently had an episiotomy. Alternately, belt portions 18 and 20 may be formed of a single piece of material which, for the treatment of hemorrhoids, would stretch from the rear of one side, across the front (behind front panel 16) to the rear of the other side.

Figure 2:
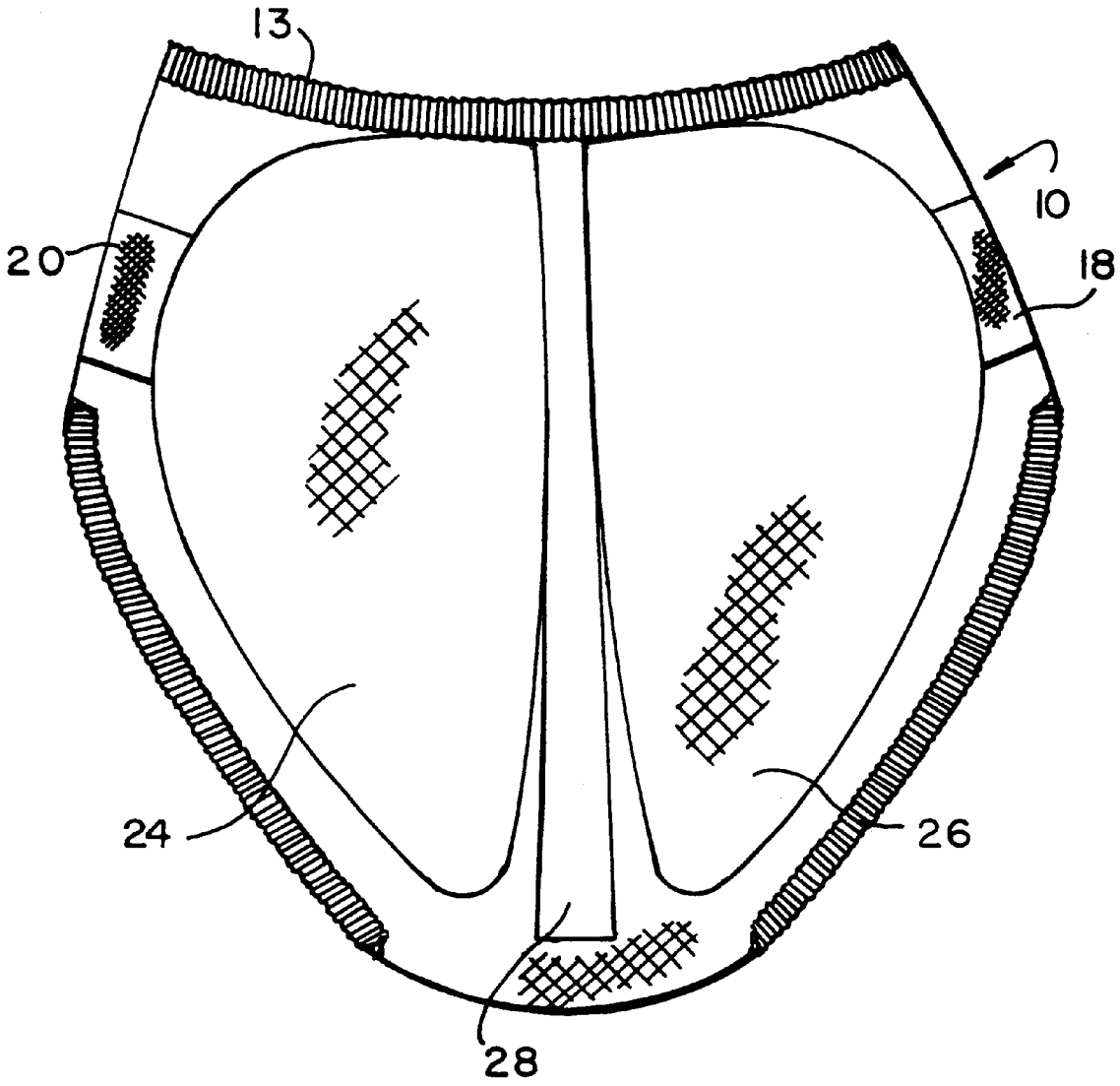
FIG. 2 is an illustrative rear view of the wearable device of FIG. 1.

FIG. 2 shows an illustrative rear view of panty undergarment 10. The rear portion of panty undergarment 10 may comprise rear panels 24 and 26, and rear enclosure 28. Rear panels 24 and 26 may be made from the same material as body portion 12, or they may be made from different material. Additionally, they may be a single panel that is integrated with body portion 12, such that body portion 12 is essentially a complete garment. Such a configuration may be useful for treatment of episiotomies, where only the features of pocket portion 22 are desired. In that case, it would be easier and less costly to manufacture body portion 12 as a single unit, that includes front panel 16 and rear panels 24 and 26.

For treatment of hemorrhoids, garment 10 may include rear enclosure 28, which can hold an item such as a small triangularly shaped cold compress or ice pack. Rear enclosure 28, like previously described pocket portion 22, allows direct access between the contents of rear enclosure 28 the inflamed area to further provide immediate relief to the user.

Garment 10, as shown in FIGS. 1 and 2, is likely to be a reusable, washable garment that can simply be thrown in the laundry. Such a garment might be available in, for example maternity wards, to new mothers. In addition, other configurations of the present invention include single-use strips that also separate swollen tissue from non-swollen tissue to relive the user of pain and discomfort.

Figure 3:
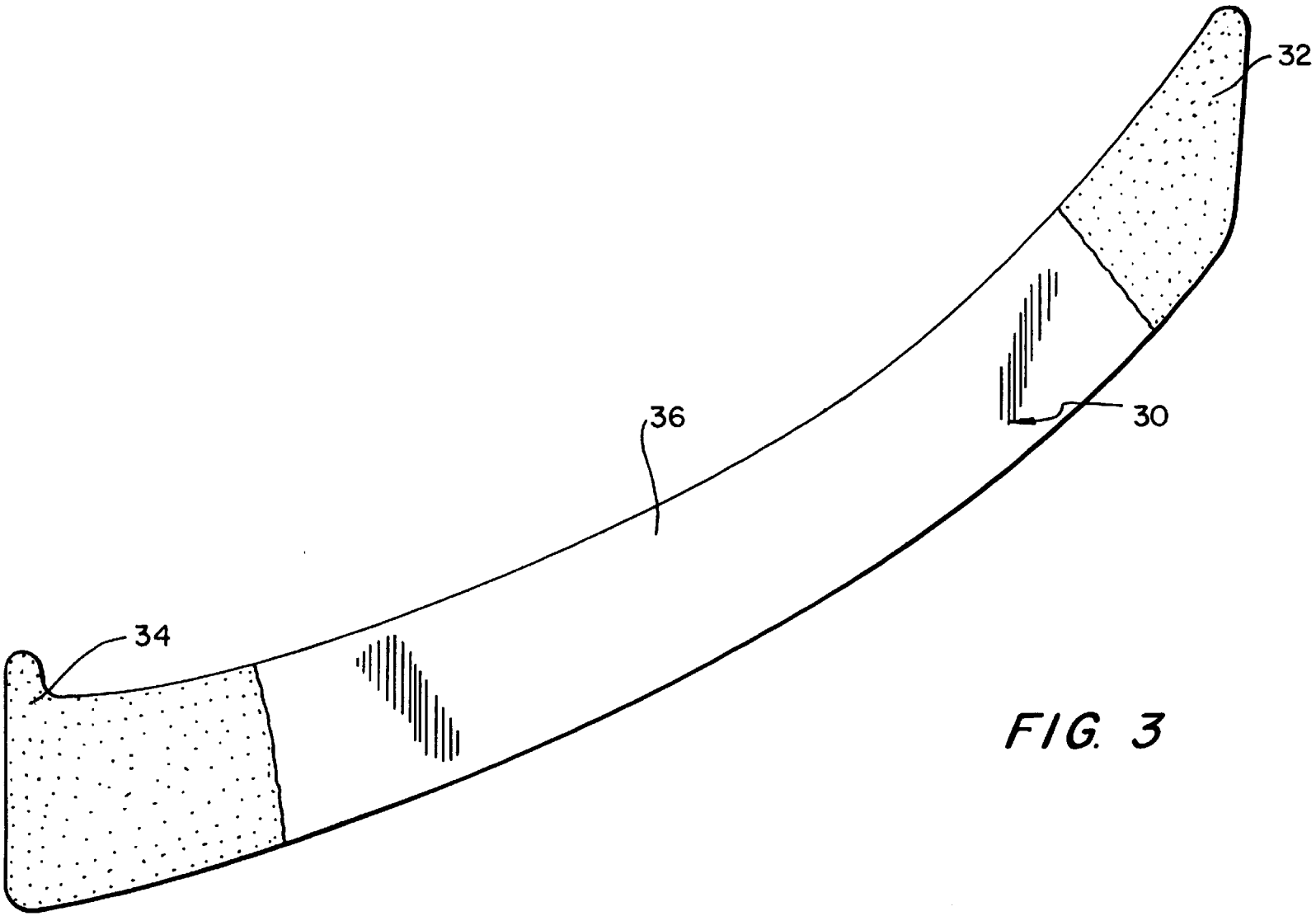
FIG. 3 is an illustrative top view of a single-use strip that may be used to separate swollen tissue from non-swollen tissue in accordance with the principles of the present invention.

FIG. 3 shows one form of the single-use strips of the present invention in tape 30. Tape 30 may be made in any shape, such as the crescent-like shape shown in FIG. 3, or other suitable shapes. The shape of tape 30, may also depend on the application. In some instances, tape 30 may be formed into pre-formed or pre-cut strips that a user simply removes a protective barrier from the adhesive area and applies it to his or her body. In such a configuration, a user might be able to purchase a box of pre-formed, single-use strips, to be used intermittently, as the need arises (for example, where a persons experiences intermittent episodes of hemorrhoids). In a less expensive version, a user might purchase a roll of strips which can be torn off and applied to the body, in accordance with the present invention, to separate swollen tissue from non-swollen tissue.

In any case, tape 30 needs to have at least some portions that are coated with an adhesive which would be applied to the body to form the pulling action necessary to separate tissue and relieve pressure from the affected area. However, to ease removal, not all of tape 30 need be coated, as shown in FIG. 3. For instance, portions 32 and 34 may be coated with adhesive, while portion 36 is not. This will make removal of tape 30 much less painful than it otherwise might be. Alternately, it may be less expensive and easier to manufacture by providing adhesive on the entire surface that would be applied to the user's body. Thus, there may be at least two different versions of tape 30 available for use. In either case, tape 30 may also include a series of attachment members (not shown) at the end (for example, at end portion 32), such as the rubber knobs described above with respect to garment 10.

In the pre-formed version, portion 32 may be adhered to the buttock, while portion 34 is adhered to the hip. To accomplish the necessary separation, portion 32 may be attached first, then tape 30 is pulled—pulling the buttock as well—and portion 34 is attached. The adhesive for attachment to the skin, is preferably a hypo-allergenic adhesive that is resistant to moisture, such as the adhesive found on nasal strips (nasal strips, which are often used for athletic activities, include a flexible stiffener that pulls the nasal passages apart and a relatively strong adhesive that keeps the strip in place, even after profuse sweating). This will insure that the required pulling affect is maintained to alleviate pressure from the affected areas.

The single-use strips may be formed from a roll of adhesive (which, while likely being more uncomfortable during removal, may be less expensive), or they may be specific, individually packaged items similar to that shown in FIG. 3. Alternately, the strip may be a single strip that is intended to stretch from one hip, across the buttocks, to the other hip (in which case, each buttock would be attached), or a single strip that attaches to each buttock and wraps around the front of the affected individual.

It will be understood that the foregoing is only illustrative of the principles of the invention, and that various modifications can be made by those skilled in the art without departing from the scope and spirit of the invention. The described embodiments are presented for the purpose of illustration rather than limitation, and the present invention is limited only by the claims which follow.

The invention claimed is:

1. An undergarment for relieving discomfort caused by swollen tissue ailments comprising:

a body portion;

a crotch portion physically connected to said body portion; and a belt portion physically connected to said body portion and that is physically distinct from said crotch portion, said belt portion being configured to maintain a separation between said swollen tissue and non-swollen tissue by pulling on opposite sides of said body portion, said separation being accomplished by the opposing forces on said body portion from said belt portion and not from said crotch portion.

2. The undergarment of claim 1, wherein said belt portion comprises:

first and second belt portions attached to said body portion, said first belt portion being attached to one side of said body portion and said second belt portion being attached to the other side of said body portion.

3. The undergarment of claim 2, wherein said first and second belt portions each comprise:

a plurality of frictional members located in the proximity of the end of each of said first and second belt portions.

4. The undergarment of claim 1, wherein said belt portion comprises:

at least one strip of material having first and second ends which act to separate said swollen tissue from said non-swollen tissue.

5. The undergarment of claim 4, wherein said first and second ends each comprise:

a plurality of frictional members that enhance the separation action of said belt portion.

6. The undergarment of claim 1, wherein said undergarment further comprises:

a first pocket portion configured to hold a first swollen tissue treatment device in close proximity with said swollen tissue.

7. The undergarment of claim 6, wherein said first pocket portion is attached within said undergarment to be aligned with an area of a person's body for treatment of swollen tissue resulting from an episiotomy.

8. The undergarment of claim 6, wherein said first pocket portion is attached within said undergarment to be aligned with an area of a person's body for treatment of swollen tissue resulting from hemorrhoids.

9. The undergarment of claim 6, wherein said first pocket portion comprises:

an absorbent material that absorbs condensation that may form from a treatment device inserted into said first pocket portion.

10. The undergarment of claim 6, wherein said first pocket portion comprises:

a fluid retention material that prevents condensation that may form from a treatment device inserted into said first pocket portion from being applied to clothing of a person wearing said undergarment.

11. The undergarment of claim 6, wherein said undergarment further comprises:

a second pocket portion configured to hold a second swollen tissue treatment device in close proximity with said swollen tissue.

12. The undergarment of claim 11, wherein said first pocket portion is attached within said undergarment to be aligned with an area of a person's body for treatment of swollen tissue resulting from an episiotomy, and said second pocket portion is attached within said undergarment to be aligned with the body for treatment of swollen tissue resulting from hemorrhoids.

13. An undergarment for relieving discomfort caused by swollen tissue ailments comprising:

a body portion;

a crotch portion physically connected to said body portion; and a belt portion physically connected to said body portion at a plurality of locations and that is physically distinct from said crotch portion, said belt portion being configured to maintain a separation between said swollen tissue and non-swollen tissue by pulling on opposite sides of said body portion such that a minimum amount of force is applied to said crotch portion, said separation being accomplished by the opposing forces on said body portion from said belt portion and not from said crotch portion.

14. The undergarment of claim 13, wherein said belt portion comprises:

first and second belt portions attached to said body portion, said first belt portion being attached to one side of said body portion and said second belt portion being attached to the other side of said body portion.

15. The undergarment of claim 14, wherein said first and second belt portions each comprise:

a plurality of frictional members located in the proximity of the end of each of said first and second belt portions.

16. The undergarment of claim 13, wherein said belt portion comprises:

at least one strip of material having first and second ends which act to separate said swollen tissue from said non-swollen tissue.

17. The undergarment of claim 16, wherein said first and second ends each comprise:

a plurality of frictional members that enhance the separation action of said belt portion.

18. An undergarment for relieving discomfort caused by swollen tissue ailments comprising:

a body portion;

a crotch portion physically connected to said body portion; and a belt portion physically connected to said body portion at a plurality of locations and that is physically distinct from said crotch portion, said belt portion being configured to maintain a separation between said swollen tissue and non-swollen tissue, said separation being accomplished by opposing forces on said body portion from said belt portion and not from said crotch portion.

19. The undergarment of claim 18, wherein said belt portion comprises:

first and second belt portions attached to said body portion, said first belt portion being attached to one side of said body portion and said second belt portion being attached to the other side of said body portion.

20. The undergarment of claim 19, wherein said first and second belt portions each comprise:

a plurality of frictional members located in the proximity of the end of each of said first and second belt portions.

21. The undergarment of claim 18, wherein said belt portion comprises:

at least one strip of material having first and second ends which act to separate said swollen tissue from said non-swollen tissue.

22. The undergarment of claim 21, wherein said first and second ends each comprise:

a plurality of frictional members that enhance the separation action of said belt portion.

* * * * *